United States Patent [19]

Van Steenkiste

[11] 4,450,765

[45] May 29, 1984

[54] APPARATUS FOR BRANDING MILK CARTONS

[76] Inventor: Roger C. Van Steenkiste, 5012 Forni Dr., Concord, Calif. 94520

[21] Appl. No.: 546,061

[22] Filed: Oct. 25, 1983

Related U.S. Application Data

[63] Continuation of Ser. No. 282,831, Jul. 13, 1981, abandoned.

[51] Int. Cl.[3] ..... B41F 17/24

[52] U.S. Cl. ..... 101/11; 101/44

[58] Field of Search ..... 101/11, 10, 9, 8, 44, 101/35, 38 R, 38 A, 43, 42, 41, 27

[56] References Cited

U.S. PATENT DOCUMENTS

| | | | |
|---|---|---|---|
| 1,252,315 | 1/1918 | Ayerst | 101/44 UX |
| 2,202,762 | 5/1940 | Freed | 101/44 |
| 2,369,172 | 2/1945 | Nordquist et al. | 101/11 |
| 2,796,827 | 6/1957 | Vantlander | 101/44 |
| 3,124,066 | 3/1964 | Crane et al. | 101/44 |
| 3,128,692 | 4/1964 | Talarico | 101/11 |
| 3,195,450 | 7/1965 | Sciame | 101/9 |
| 3,269,305 | 8/1966 | Rossi | 101/35 |
| 3,405,633 | 10/1968 | Price, Jr. et al. | 101/38 A X |
| 3,540,371 | 11/1970 | Rudolph et al. | 101/126 X |

*Primary Examiner*—Clifford D. Crowder
*Attorney, Agent, or Firm*—John L. McGannon

[57] ABSTRACT

An apparatus and a method for applying permanent indicia, such as numbers representing calendar dates, on surface portions of plastic containers, such as containers for holding milk. The apparatus includes a heated die and an inked web mounted on a support plate in positions to cause the indicia-forming elements on the die to engage and force a portion of the web into intimate contact with a flat surface portion of a container. The die effectively brands the container and the ink on the web portion is transferred into the branded portion of the container to render the branded portion readily observable. The containers are moved incrementally past the die and web portion by a conveyor. A container holding device is mounted in a fixed location on the opposite side of the conveyor aligned with the die so that each container is held against lateral movement as the die forces the web portion into contact with the surface of the container to be branded. The web is advanced incrementally past the die so that an unused segment of the web is always aligned with the die before the die is moved toward the container for branding.

1 Claim, 5 Drawing Figures

APPARATUS FOR BRANDING MILK CARTONS

This is a continuation of application Ser. No. 282,831 filed July 13, 1981, abandoned.

This invention relates to improvements in the automatic marking of containers, and more particularly, to apparatus and a method for branding plastic containers.

BACKGROUND OF THE INVENTION

Plastic containers containing foodstuffs are often required to be dated so that if consumers do not purchase the foodstuffs in the containers by a certain date, the foodstuffs have to be destroyed. Milk is a good example of a product which must be dated.

Milk is oftentimes sold in plastic containers of a type having sloping upper flat surface portion extending downwardly from an open, externally threaded neck which receives a cap. It has been found appropriate to mark the containers of this type with the date on the upper flat sloping surface so that the date represented by the marking can readily be observed. While these containers can be marked by hand, this becomes a tedious process when so many containers as are normally required have to be marked.

Attempts have been made in the past to mark containers of this type automatically. For the most part, these attempts have proven to be satisfactory to some degree, but improvements have been needed because of the complexity and expense in providing simplified apparatus and methods for accomplishing this purpose.

SUMMARY OF THE INVENTION

The present invention satisfies the aforesaid by providing an apparatus and a method for marking a plurality of plastic containers with indica which readily stands out from the containers and as the containers move along a path represented by a conveyor. The present invention operates to brand the containers with the desired indicia and at the same time to fill the branded portion of the container with a colored ink so that the indicia are readily observable and indicia are always applied to the containers at the same locations thereon.

The invention includes a die having replaceable indicia-defining element wherein the die, when heated, moves into engagement with a portion of an inked web to force the web portion against a plastic container. The heat from the heated die not only brands the container but transfers the ink from the web into the grooves defining the indicia on the container. Thus, the ink, which is in contrast to the color of the container, causes the indicia branded into the container to stand out and be prominently displayed so that the information represented by the indicia can readily be determined. Thus, the brand and the ink in the container provide a permanent marking of the container, one which cannot be eliminated except by reheating of the container.

As the die and web portion are forced against the container, the container is held by a holding device. This holding device is fluid actuated and operates in conjunction with the movement of the die and the movement of the conveyor. All of the components of the apparatus are hereby under a single control which permits automatic operation of the apparatus so that a plurality of plastic containers can be marked in minimum time.

The primary object of this invention is to provide an improved container-marking apparatus and method wherein each of a plurality of plastic containers can not only be branded with certain indicia but can be provided with a colored background for the indicia so that the indicia are readily viewable and can be placed on the various containers at the same locations thereon.

Other objects of this invention will become apparent as the following specification progresses, reference being had to the accompanying drawing for an illustration of this invention.

IN THE DRAWINGS

Figure 3:
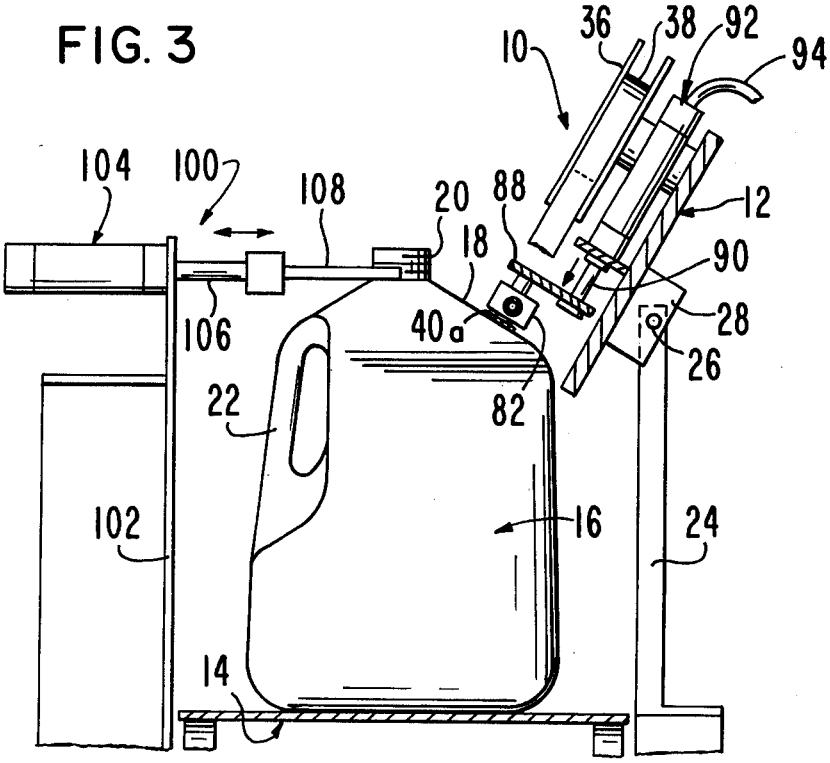
FIG. 3 is a vertical section through the apparatus of FIG. 1, showing the way it is used in marking a plastic container moveable on a conveyor past the apparatus.

The marking apparatus in a first embodiment of the present invention is broadly denoted by the numeral 10 and includes a support plate 12 which is mounted in a fixed position in any suitable manner at one side of a conveyor 14 (FIG. 3) which moves in a generally horizontal direction. The conveyor is adapted to support a plurality of plastic containers 16 of the type having an inclined, upper, generally flat surface 18 sloping downwardly from an open, externally threaded neck 20. The container has a handle 22 molded along with the body of the container and the handle is opposite to the generally flat surface portion 18 as shown in FIG. 3

For purposes of illustration, plate 12 is mounted on an upright support 24 by means of a pin 26 passing through a pair of lateral projections 28 rigid to the rear face 30 of support plate 12. This allows the support plate to be mounted at an angle as shown in FIG. 3 and this angle can be varied if desired, depending on the slope of surface portion 18 of container 16.

Apparatus 10 further includes a first reel 32 mounted on the front face 34 of plate 12 for rotation about the axis of a shaft 36 mounted on plate 12 in any suitable manner. Reel 32 is adapted to receive and support a roll 38 of an inked, porous web 40 which can be made of fabric or other suitable material. Web 40 permits transfer of colored ink from the web onto surface portion 18 in a manner to be described.

Web 40 extends outwardly from reel 32 and passes about four idler rollers 42, 44, 46, and 48, all of the idler rollers being mounted on support plate 12 and projecting outwardly from front face 34 thereof. Rollers 42 and 44 are vertically spaced from each other, rollers 44 and 46 are horizontally spaced from each other, and rollers 46 and 48 are vertically spaced from each other. The positions of rollers 44 and 46 are such that the web has a generally horizontally extending portion **40*a* moveable in a direction denoted by arrow 50 (FIG. 1) so that the web is fed off of roll 38**.

Figure 1:
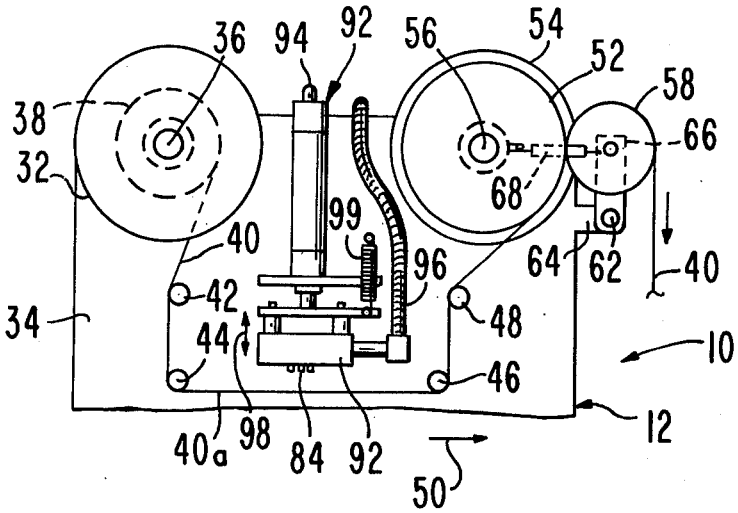
FIG. 1 is a front elevational view of a first embodiment of the marking apparatus of the present invention.
Figure 2:
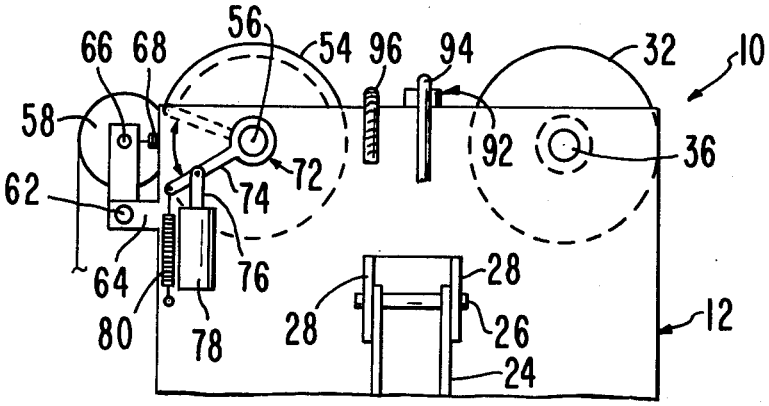
FIG. 2 is a rear elevational view of the apparatus of FIG. 1.

Web 40 extends upwardly and away from idler roller 48 and engages the outer periphery 52 of a second reel 54 mounted on a shaft 56 rotatable on plate 12. Shaft 56 is parallel with shaft 36. The web also passes over and partially about a wheel 58 pivotally mounted by an arm 60 and a pin 62 on a lateral projection 64 of plate 12 as shown in FIGS. 1 and 2. The wheel is rotatably mounted on arm 60 by a pin 66, and wheel 58 forces web 40 against outer periphery 52 of reel 54 so that outer periphery 52 is in driving relationship to the web. A coil spring 68 coupled with arm 60 and with the bearing 70 of shaft 56 biases wheel 58 toward reel 54 so that web 40 is under pressure where outer periphery 52 and wheel 58 are in the closest proximity to each other. The web extends away from wheel 58 and to a take-up means (not shown).

Web 40 is advanced incrementally relative to plate 12 when apparatus 10 is in operation. This is accomplished in any suitable manner. For purposes of illustration, it is accomplished by a ratchet assembly 72 on shaft 56, such ratchet assembly being of the type used with socket wrenches which are conventional in construction. The ratchet assembly includes an arm 74 which projects radially from shaft and is pivotally coupled to the shaft 76 air cylinder 78 mounted in any suitable manner on the rear face 30 of plate 12. A coil spring 80 biases arm 74 into the full line position of FIG. 2.

When air cylinder 78 is pulsed air, shaft 76 moves upwardly when viewing FIG. 2, causing arm 74 to rotate in a clockwise sense to advance reel 54 in a counterclockwise sense when viewing FIG. 1. This movement of the reel is through a predetermined angle depending upon the stroke of the air cylinder. Each time reel 54 moves in a counterclockwise sense, it advances web 40 in the direction of arrow 50. As the web advances, web portion 40*a* also advances by the same increment, causing a new segment of portion 48 to be centered between idler rollers 44 and 46

Apparatus 10 further includes a die 82 having indicia-forming elements 84 on a lower, flat surface 86 of the die. The purpose of the die is to brand indicia in surface portion 18 and to form a colored marking in the branded portion of container 16 when the die, being heated, is forced against web portion 40*a* and, in turn, causes the web portion 40*a* to engage surface portion 18 as shown in FIG. 3. In this way, dates or other indicia can be applied to container 16 in a simple and expeditious manner, all to the end that a great number of containers 16 can be provided with indicia in a minimum of time.

Die 82 is mounted on a plate 88 carried on the outer end of a reciprocal rod 90 which projects outwardly from a fluid actuated power device 92, such as a pneumatic device. The power fluid for driving device 92 is supplied by a tube 94 which is directed to a source of the fluid under pressure, such as air under pressure.

Device 92 is rigidly secured in any suitable manner to the front face 34 of support plate 12. Device 92 is located between reels 32 and 54 as shown in FIG. 1.

Die 82 has an electrical resistance element (not shown) embedded therewithin in a heat exchange relationship thereto. The element is provided with a voltage from an electrical source (not shown) and the electrical leads between the element and the electrical power source extend through a flexible conduit 96 which permits movement of die 82 in the direction of arrows 98 (FIG. 1) when device 92 is alternately actuated and deactuated. A spring 99 biases die 82 upwardly when viewing FIG. 1.

A container holding device 100 (FIG. 3) is provided near conveyor 14 on the side opposite to the side having apparatus 10. Holding device 100 includes an upright mount 102 having a fluid actuated device 104 at the upper end thereof. The device includes a reciprocal rod 106 having a holding member 108 at the outer end thereof, member 108 having a forked or bifurcated outer end which straddles neck 20 of a container 16 in the manner shown in FIG. 3. Thus, when web portion 40*a* is forced against surface 18 by die 82, the container will remain rigidly positioned on conveyor 14 and will not move to the side by the force exerted by the die.

In operation, a plurality of containers 16 are placed on conveyor 14 and moved one by one past apparatus 10 and holding device 100. The conveyor is operated under a suitable control so that incremental movement of the conveyor will position a container 16 such that its flat, inclined, upper surface portion 18 will be directly aligned with elements 84 on die 82 and generally midway between idler rollers 44 and 46.

When a container 16 is moved into position, device 104 is automatically triggered to cause holding member 108 to move into the position of FIG. 3 in proximity to neck 20. Then, device 92 is actuated to cause die 82 to move downwardly and to force web portion 40*a* into intimate contact with surface portion 18 of container 16. When this occurs, the heat of the die causes the plastic of surface portion 18 to melt and the outline of the elements defining the indicia on the die are then formed or branded into surface portion 18. Simultaneously, the colored ink in the web portion 40*a* will flow into the grooves of the indicia branded into surface portion 18 so that the grooves will stand out and be readily noticeable when surface portion 18 is thereafter viewed.

After the actuation of device 92, die 82 is retracted, and at the same time, device 104 is deactuated to cause retraction of member 108. Then, conveyor 14 is incrementally advanced and at the same time, solenoid 78 is actuated to incrementally rotate reel 54. Thus, the next container moves into position aligned with the die and a new segment of web 40*a* is moved into position aligned with the die elements 84. In this way, a new segment of web portion 40*a* is always aligned with the die elements 84 before the die is shifted toward the container.

The present invention provides a simple and reliable means for marking plastic containers quickly and easily and without operator handling of the containers. It is only necessary that a plurality of containers be placed on conveyor 14 and the controls actuated so that the containers move incrementally past the die. The only operator requirement is to keep an adequate supply of containers on the conveyor.

Figure 4:
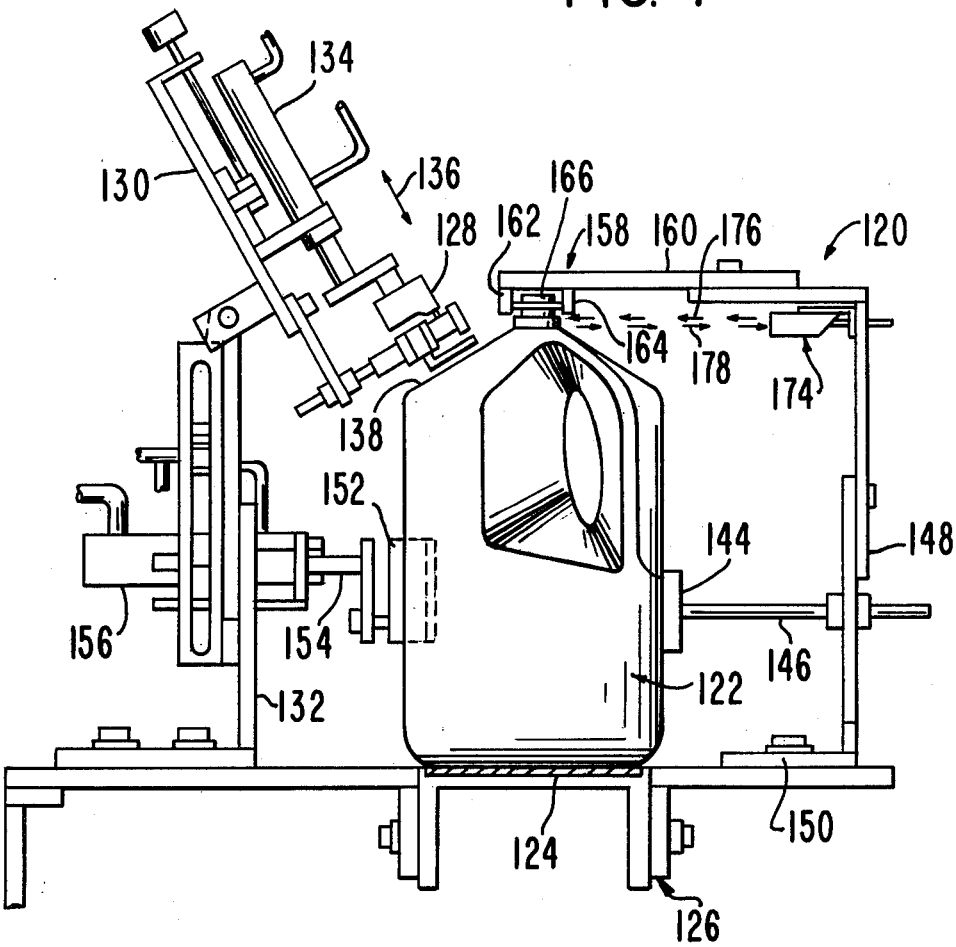
FIG. 4 is a view similar to FIG. 3 but showing another embodiment of the apparatus with a different type of holding means.
Figure 5:
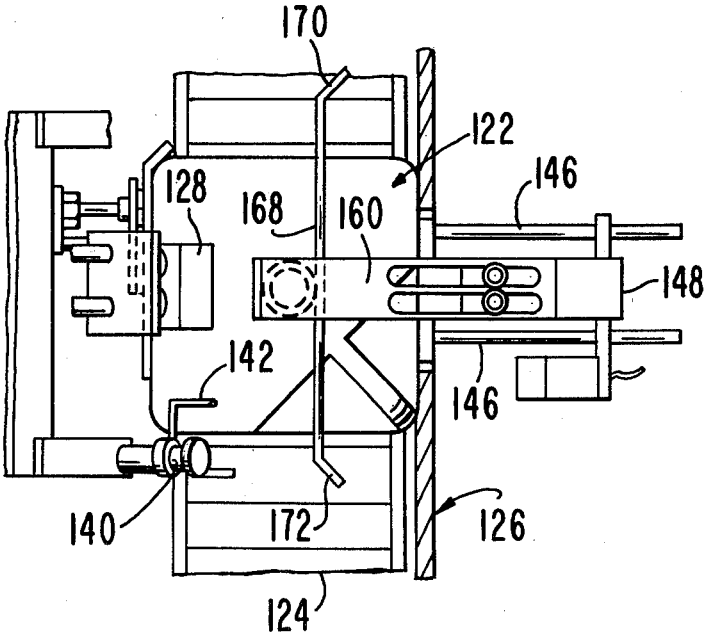
FIG. 5 is a fragmentary, top plan view of the apparatus of FIG. 4.

Another embodiment of the apparatus of the present invention is shown in FIGS. 4 and 5 and denoted by the numeral 120. Apparatus 120 is similar in certain respects to apparatus 10 of FIGS. 1–3 but differs from apparatus 10 in that it has a different holding device for containers 122 movable in a generally horizontal direction by means of a conveyer 124 on a fixed support 126. Apparatus 120 has heated die carried by a support plate 130 on an upright post 132 coupled at its base to support 126. A fluid actuated piston and cylinder assembly 134 operates to cause die 128 to move in the direction of arrow 136 into and out of engagement with a flat upper surface 138 of container 122 to brand the container and to transfer a color into the brand from the colored ink in a web (not shown) of the type similar to web 40 of FIGS. 1–3. The various guides for the web are shown in FIGS. 4 and 5, including an idler reel 140 and a guide post 142 at one side of die 128.

The holding means for apparatus 120 includes a fixed backing plate 144 carried on a post 146 secured to an upright post 148 whose base 150 is secured to support 126 on one side of the conveyor. A second plate 152 is on the opposite side of the conveyor from plate 144. Plate 152 is carried on a rod 154 of a fluid piston and cylinder assembly 156 secured to an upright post 132. Plate 152 is retractable by operation of assembly 156 so as to permit the movement of a container 122 out from between plates 144 and 152 and to allow the next adjacent container to move into position between the plates. Then, assembly 156 is actuated to cause plate 152 to move into engagement with the next container to force the latter against plate 144.

The holding means further includes a guide structure 158 comprised of a horizontal extension 160 secured to and extending laterally from the upper end of post 148. Extension 160 has a pair of guide bars 162 and 164 near the outer end thereof for receiving the neck 166 of container 122 therebetween as the container is moved by the conveyor. A guide rod 168 having angled ends 170 and 172 is also carried by extension 160 and operates to assure that the neck 166 of a container is properly directed into the space between guide bars 162 and 164 as the container moves into a position to be branded by die 128.

An additional feature of appratus 120 is a detector unit 174 carried by post 148 for detecting the presence of a container neck 166 in the space between guide bars 162 and 164. Detector unit 174 includes a radiation source and a photodetector, the source emitting a beam 176 which is reflected as a beam 178 for return to the photodetector. Upon actuation of the photodetector, assembliers 134 and 156 are actuated to cause the container to be branded and held, respectively, in a predetermined sequence. In this way, a large number of containers can be branded in a minimum of time.

I claim:

1. Apparatus for marking a plurality of plastic containers one-by-one with each container having a neck and a flat side wall comprising: a conveyor for supporting and moving the containers in upright positions along a predetermined path; means for applying indicia to each container, respectively, when the container is at a predetermined location along the path, said applying means including a heated die having indicia thereon, means including a tiltable support plate on one side of the conveyor for mounting the die for movement transversely of said path and toward and into heat exchange relationship with the side wall of a container to be branded with the indicia on the die, and a flexible inked web between the die and a container at said predetermined location for transferring ink from the web to the branded portion of a container at said predetermined location, said die being engageable with one side of a segment of the web and operable to shift said web segment into engagement with a container at said predetermined location, there being means coupled with the web for incrementally advancing the web past the die; means including a reciprocal rod on the opposite side of the conveyor from the applying means for releasably holding the neck of a container at said predetermined location against movement relative to the applying means as the conveyor supports the container and as the container is branded by the die; and second holding means including a pair of holding members on opposite sides of the conveyor for engaging the side wall of a container at said predetermined location, one of the members being shiftable, the other member being fixed.

* * * * *